US006515032B2

(12) United States Patent
Moore, Jr. et al.

(10) Patent No.: US 6,515,032 B2
(45) **Date of Patent: *Feb. 4, 2003**

(54) CO-HYDROPROCESSING OF FISCHER-TROPSCH PRODUCTS AND NATURAL GAS WELL CONDENSATE

(75) Inventors: Richard O. Moore, Jr., San Rafael, CA (US); Roger D. Van Gelder, Beaconsfield (GB)

(73) Assignee: Chevron U.S.A. Inc., San Ramon, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/854,195

(22) Filed: May 11, 2001

(65) Prior Publication Data

US 2002/0169218 A1 Nov. 14, 2002

(51) Int. Cl.[7] ..... C07C 27/00; C07C 5/13; C10G 35/06

(52) U.S. Cl. ..... 518/700; 518/702; 585/734; 585/750; 208/136

(58) Field of Search ..... 518/700, 702; 585/734, 750; 208/136

(56) References Cited

U.S. PATENT DOCUMENTS

| | | | |
|---|---|---|---|
| 4,568,663 | A | 2/1986 | Mauldin |
| 5,536,687 | A | 7/1996 | Ward |
| 5,885,438 | A | 3/1999 | Apelian et al. |
| 5,925,235 | A | 7/1999 | Habib |
| 5,993,643 | A | 11/1999 | Chang et al. |
| 6,030,921 | A | 2/2000 | Ziemer |
| 6,051,127 | A | 4/2000 | Moureaux |
| 6,075,061 | A | 6/2000 | Wittenbrink et al. |
| 6,093,672 | A | 7/2000 | Winquist et al. |
| 6,096,940 | A | 8/2000 | Wittenbrink et al. |
| 6,168,768 | B1 | 1/2001 | Alexion et al. |
| 6,225,359 | B1 | 5/2001 | O'Rear et al. |

FOREIGN PATENT DOCUMENTS

| | | |
|---|---|---|
| EP | 0321305 A2 | 6/1989 |
| EP | 0512635 A2 | 11/1992 |
| EP | 0583836 A1 | 2/1994 |
| EP | 0609079 A1 | 8/1994 |
| EP | 0921184 A1 | 6/1999 |

*Primary Examiner*—Jafar Parsa
(74) *Attorney, Agent, or Firm*—Burns, Doane, Swecker & Mathis, L.L.P.

(57) ABSTRACT

An integrated process for producing a hydrocarbon stream including $C_{5-20}$ normal and iso-paraffins is disclosed. A de-sulfurized methane-rich stream and a natural gas condensate are isolated from the natural gas source. The methane-containing stream is converted into syngas, which is then subjected to a hydrocarbon synthesis process, for example, Fischer-Tropsch synthesis. One or more fractions from the hydrocarbon synthesis are blended with the natural gas condensate for co-hydroprocessing, where the blended stream includes less than about 200 ppm sulfur. Olefins and oxygenates are hydrotreated to form paraffins. Paraffins are subjected to hydroisomerization conditions to form isoparaffins. Hydrocarbons with chain lengths above a desired value, for example, $C_{24}$, are hydrocracked. The hydrogenolysis that would otherwise form undesired $C_{1-4}$ fractions is minimized by judicious selection of noble metal catalysts.

16 Claims, No Drawings

CO-HYDROPROCESSING OF FISCHER-TROPSCH PRODUCTS AND NATURAL GAS WELL CONDENSATE

FIELD OF THE INVENTION

This invention is generally in the area of the Fischer-Tropsch synthesis.

BACKGROUND OF THE INVENTION

The majority of fuel today is derived from crude oil. Crude oil is in limited supply, and fuel derived from crude oil tends to include nitrogen-containing compounds and sulfur-containing compounds, which are believed to cause environmental problems such as acid rain.

Although natural gas includes some nitrogen- and sulfur-containing compounds, methane can be readily isolated in relatively pure form from natural gas using known techniques. Many processes have been developed which can produce fuel compositions from methane. Most of these process involve the initial conversion of methane to synthesis gas ("syngas").

Fischer-Tropsch chemistry is typically used to convert the syngas to a product stream that includes a broad spectrum of products, ranging from methane to wax, with a significant amount of hydrocarbons in the distillate fuel range ($C_{5-20}$).

Methane tends to be produced when chain growth probabilities are low, which is generally not preferred. Heavy products with a relatively high selectivity for wax are produced when chain growth probabilities are high. The wax can be processed to form lower molecular weight products, but this processing often results in undesired formation of $C_{1-4}$ products. Paraffinic Fischer-Tropsch products tend to be mostly linear, and tend to have relatively low octane values, high cetane numbers, relatively high pour points and relatively low sulfur contents. They are often hydrocracked and isomerized to provide products with desired boiling ranges and pour point values.

Many isomerization catalysts require low levels of sulfur and nitrogen impurities, and feed streams for these catalysts are often hydrotreated to remove any sulfur and nitrogen compounds. When isomerization processes are carried out with certain non-sulfided catalysts, various side reactions, such as hydrogenolysis (non-selective hydrocracking), can occur, producing undesired $C_1$–$C_4$ hydrocarbons. One approach to dealing with this limitation is to suppress hydrogenolysis by incorporating a small amount of sulfur-containing compounds into the feed, or by using other hydrocracking suppressants. A disadvantage of this approach is that it adds sulfur compounds to an otherwise essentially sulfur-free composition, which may not be desired.

It would be advantageous to provide additional processes for treating Fischer-Tropsch products which minimize hydrogenolysis and which do not require the addition of sulfur compounds. The present invention provides such a process.

SUMMARY OF THE INVENTION

An integrated process for producing a hydrocarbon stream, preferably including predominantly $C_{5-20}$ normal and iso-paraffin fraction, is disclosed. The process involves isolating a methane-rich stream, i.e. predominantly a $C_4$– stream, and a $C_5$+ stream ("natural gas condensate") from a natural gas source. The methane-rich stream is treated to remove sulfur-containing impurities, if necessary, then converted to syngas, and the syngas used in a hydrocarbon synthesis process, for example, Fischer-Tropsch synthesis.

One or more fractions from the hydrocarbon synthesis are blended with the natural gas condensate such that the overall sulfur content of the blend is less than about 200 ppm. If necessary, the natural gas condensate can be treated to lower the sulfur content so that the blend has an acceptable sulfur level. In one embodiment, the fraction from the hydrocarbon synthesis is predominantly a $C_{5-20}$ fraction. In another embodiment, the fraction is predominantly a $C_{20}$+ fraction. In a third embodiment, the fraction is predominantly a $C_5$+ fraction.

The blended hydrocarbons are subjected to hydroprocessing conditions. Olefins and oxygenates are hydrotreated to form paraffins. Paraffins are subjected to hydroisomerization conditions to form isoparaffins. Hydrocarbons with chain lengths above a desired value, for example, $C_{24}$+, are hydrocracked. The hydroprocessing catalysts are selected for high selectivity to $C_5$+ products in the absence of substantial amounts of feed sulfur. Thus, one or more fractions from the hydrocarbon synthesis are combined with the natural gas condensate and the hydroprocessing conditions adjusted to maximize formation of a middle distillate product. The catalyst preferred for the hydroprocessing step is a noble metal-containing catalyst, selected for high yield of desired products without the hydrogenolysis normally encountered when using base metal catalysts in a low-sulfur environment.

After the hydroprocessing step, any remaining heteroatom-containing compounds can be removed, for example, using adsorption, extractive Merox or other means well known to those of skill in the art. The processes described herein significantly reduce hydrogenolysis that would otherwise form a significant $C_1$–$C_4$ fraction without requiring the presence of undesired sulfur in the final product.

DETAILED DESCRIPTION OF THE INVENTION

An integrated process for producing a hydrocarbon stream, preferably including a predominantly $C_{5-20}$ normal and iso-paraffin fraction, is disclosed. The process is particularly useful in the production of middle distillate fractions boiling in the range of about 250–700° F., as determined by an appropriate ASTM procedure. The resulting product streams advantageously include low sulfur concentrations, in contrast to product streams prepared using pre-sulfided catalysts or when including added sulfur as a hydrocracking suppressant.

The term "middle distillate fraction" is defined as a substantially hydrocarbon stream with at least 75 volume percent of the stream having a normal boiling point of greater than about 250° F. and with at least 75 volume percent of the stream having a normal boiling point less than about 700° F. The term "middle distillate" is intended to include the diesel, jet fuel and kerosene boiling range fractions. The kerosene or jet fuel boiling point range is intended to refer to a temperature range of about 280–525° F. and the term "diesel boiling range" is intended to refer to hydrocarbon boiling points of about 250–700° F. Gasoline or naphtha is normally referred to as having a boiling point of between $C_5$ and about 400° F.

The boiling point ranges of the various product fractions recovered in any particular refinery will be expected to vary with such factors as the characteristics of the feedstreams, local markets, product prices, and the like. However, reference is made to ASTM standards D-975 and D-3699-83 for further details on kerosene and diesel fuel properties.

The process involves isolating a methane-rich stream and a $C_5$+ stream ("natural gas condensate") from a natural gas source. The methane-rich stream (predominantly a $C_4$− stream), or a portion thereof, is converted to syngas, and the syngas used in a hydrocarbon synthesis process, for example, Fischer-Tropsch synthesis.

One or more fractions from the hydrocarbon synthesis are blended with the natural gas condensate such that the overall sulfur content of the blend is less than about 200 ppm. If necessary, the natural gas condensate can be pretreated to lower the sulfur content so that the blend has an acceptable sulfur level, and, optionally, one or more fractions from the hydrocarbon synthesis step can be pretreated to lower the concentrations of oxygenates and/or olefins. In one embodiment, the fraction from the hydrocarbon synthesis is predominantly a $C_{5-20}$ fraction. In another embodiment, the fraction is predominantly a $C_{20}$+ fraction. In a third embodiment, the fraction is predominantly a $C_5$+ fraction. As used herein, carbon number ranges for hydrocarbons are indicated using "Cn" designations: $C_5$+ indicates a carbon number of 5 or higher, $C_{5-20}$ indicates a carbon range between 5 and 20, inclusively, $C_{2-4}$ indicates a carbon range between 2 and 4 inclusively, $C_{20}$ indicates a carbon number of 20, etc.

Natural Gas

In addition to methane, natural gas includes some heavier hydrocarbons (mostly $C_{2-5}$ paraffins) and other impurities, e.g., mercaptans and other sulfur-containing compounds, carbon dioxide, nitrogen, helium, water and non-hydrocarbon acid gases. Natural gas fields also typically contain a significant amount of $C_5$+ hydrocarbons (natural gas condensate), which is liquid at ambient conditions.

The natural gas condensate may or may not include an appreciable amount of sulfur-containing compounds, depending on the natural gas source and any pre-treatments to remove sulfur. The sulfur content of the natural gas condensate may or may not be lowered, depending on whether the sulfur content of the blend of the natural gas condensate and the hydrocarbon synthesis products is above about 200 ppm.

The methane and, optionally, some or all of the $C_{2-4}$ hydrocarbons can be isolated and used to generate syngas. Various other impurities can be readily separated. Inert impurities such as nitrogen and helium can be tolerated.

Syngas

Methane and other low molecular weight ($C_{2-4}$) hydrocarbons can be sent through a conventional syngas generator to provide synthesis gas. Typically, synthesis gas contains hydrogen and carbon monoxide, and may include minor amounts of carbon dioxide and/or water.

The presence of sulfur, nitrogen, halogen, selenium, phosphorus and arsenic contaminants in the syngas is undesirable. For this reason, it is preferred to remove sulfur and other contaminants from the feed before performing the Fischer-Tropsch chemistry or other hydrocarbon synthesis. Means for removing these contaminants are well known to those of skill in the art. Hydrotreating processes may be used to remove a large proportion of the sulfur from the methane-rich stream. Alternatively or additionally, ZnO guard beds may be used for removing sulfur impurities. Means for removing other contaminants are well known to those of skill in the art.

Fischer-Tropsch Synthesis

Catalysts and conditions for performing Fischer-Tropsch synthesis are well known to those of skill in the art, and are described, for example, in EP 0 921 184 A1, the contents of which are hereby incorporated by reference in their entirety.

In the Fischer-Tropsch synthesis process, liquid and gaseous hydrocarbons are formed by contacting a synthesis gas (syngas) comprising a mixture of $H_2$ and CO with a Fischer-Tropsch catalyst under suitable temperature and pressure reactive conditions. The Fischer-Tropsch reaction is typically conducted at temperatures of about from 300 to 700° F. (149 to 371° C.) preferably about from 400° to 550° F. (204° to 228° C.); pressures of about from 10 to 600 psia, (0.7 to 41 bars) preferably 30 to 300 psia, (2 to 21 bars) and catalyst space velocities of about from 100 to 10,000 cc/g/hr., preferably 300 to 3,000 cc/g/hr.

The products range from $C_1$ to $C_{200}$+ with a majority in the $C_5$ to $C_{100}$+ range. The reaction can be conducted in a variety of reactor types for example, fixed bed reactors containing one or more catalyst beds, slurry reactors, fluidized bed reactors, or a combination of different type reactors. Such reaction processes and reactors are well known and documented in the literature. Slurry Fischer-Tropsch processes, which is a preferred process in the practice of the invention, utilize superior heat (and mass) transfer characteristics for the strongly exothermic synthesis reaction and are able to produce relatively high molecular weight, paraffinic hydrocarbons when using a cobalt catalyst. In a slurry process, a syngas comprising a mixture of $H_2$ and CO is bubbled up as a third phase through a slurry in a reactor which comprises a particulate Fischer-Tropsch type hydrocarbon synthesis catalyst dispersed and suspended in a slurry liquid comprising hydrocarbon products of the synthesis reaction which are liquid at the reaction conditions. The mole ratio of the hydrogen to the carbon monoxide may broadly range from about 0.5 to 4, but is more typically within the range of from about 0.7 to 2.75 and preferably from about 0.7 to 2.5. A particularly preferred Fischer-Tropsch process is taught in EP0609079, also completed incorporated herein by reference for all purposes.

Suitable Fischer-Tropsch catalysts comprise on or more Group VIII catalytic metals such as Fe, Ni, Co, Ru and Re. Additionally, a suitable catalyst may contain a promoter. Thus, a preferred Fischer-Tropsch catalyst comprises effective amounts of cobalt and one or more of Re, Ru, Pt, Fe, Ni, Th, Zr, Hf, U, Mg and La on a suitable inorganic support material, preferably one which comprises one or more refractory metal oxides. In general, the amount of cobalt present in the catalyst is between about 1 and about 50 weight percent of the total catalyst composition. The catalysts can also contain basic oxide promoters such as $ThO_2$, $La_2O_3$, MgO, and $TiO_2$, promoters such as $ZrO_2$, noble metals (Pt, Pd, Ru, Rh, Os, Ir), coinage metals (Cu, Ag, Au), and other transition metals such as Fe, Mn, Ni, and Re. Support materials including alumina, silica, magnesia and titania or mixtures thereof may be used. Preferred supports for cobalt containing catalysts comprise titania. Useful catalysts and their preparation are known and illustrative, but nonlimiting examples may be found, for example, in U.S. Pat. No. 4,568,663.

The products from Fischer-Tropsch reactions performed in slurry bed reactors generally include a light reaction product and a waxy reaction product. The light reaction product (a predominantly $C_{5-20}$ fraction, commonly termed the "condensate fraction") includes hydrocarbons boiling below about 700° F.(e.g., tail gases through middle distillates), with decreasing amounts up to about $C_{30}$. The waxy reaction product (a predominantly $C_{20}$+ fraction, commonly termed the "wax fraction") includes hydrocarbons boiling above about 600° F. (e.g., vacuum gas oil through heavy paraffins), with decreasing amounts down to $C_{10}$. Both the light reaction product and the waxy product are substantially paraffinic. The waxy product generally comprises greater than 70% normal paraffins, and often greater than 80% normal paraffins. The light reaction product comprises paraffinic products with a significant proportion of alcohols and olefins. In some cases, the light reaction product may comprise as much as 50%, and even higher, alcohols and olefins.

In the process, at least a portion of the product stream from the hydrocarbon synthesis is blended with at a portion of the natural gas condensate, the prepare a stream containing less than about 200 ppm sulfur. A preferred product stream from the hydrocarbon synthesis includes $C_{5-20}$ hydrocarbons.

Hydroprocessing

The stream produced by blending hydrocarbon synthesis product and the natural gas condensate is subjected to hydroprocessing conditions using a noble metal-containing catalyst. The hydroprocessing conditions include one or more of hydrotreating, hydroisomerization and/or hydrocracking. During hydroprocessing, olefins and oxygenates may be hydrotreated to form paraffins, paraffins may be hydroisomerized to form isoparaffins and hydrocarbons with chain lengths above a desired value, for example, $C_{24}$, may be hydrocracked.

More than one catalyst type may be used in the hydroprocessing step. The different catalyst types can be separated into layers or mixed. The hydroprocessing conditions can be varied depending on the fractions derived from the hydrocarbon synthesis step. For example, if the fractions include predominantly $C_{20}$+ hydrocarbons, the hydroprocessing conditions can be adjusted to hydrocrack the fraction and provide predominantly $C_{5-20}$ hydrocarbons. If the fractions include predominantly $C_{5-20}$ hydrocarbons, the hydroprocessing conditions can be adjusted to minimize hydrocracking. Those of skill in the art know how to modify reaction conditions to adjust amounts of hydrotreatment, hydroisomerization, and hydrocracking.

Hydrotreating

As used herein, "hydrotreating" or "hydrotreatment" is given its conventional meaning and describes processes that are well known to those skilled in the art. Hydrotreating refers to a catalytic process, usually carried out in the presence of free hydrogen, for desulfurization and/or denitrification of the feedstock, for oxygenate removal and for olefin saturation, depending on the particular needs of the refiner and on the composition of the feedstock. The sulfur is generally converted to hydrogen sulfide, the nitrogen is generally converted to ammonia and the oxygen converted to water, and these can be removed from the product stream using means well known to those of skill in the art. Hydrotreating conditions include a reaction temperature between 400° F.–900° F. (204° C.–482° C.), preferably 650° F.–850° F. (343° C.–454° C.); a pressure between 500 to 5000 psig (pounds per square inch gauge) (3.5–34.6 MPa), preferably 1000 to 3000 psig (7.0–20.8 MPa); a feed rate (LHSV) of 0.5 $hr^{-1}$ to 20 $hr^{-1}$ (v/v); and overall hydrogen consumption 300 to 2000 scf per barrel of liquid hydrocarbon feed (53.4–356 $m^3$ $H_2/m^3$ feed). The hydrotreating catalyst for the beds will typically be a composite of a Group VI metal or compound thereof, and a Group VIII metal or compound thereof supported on a porous refractory base such as alumina. Examples of hydrotreating catalysts are alumina supported cobalt-molybdenum, nickel sulfide, nickel-tungsten, cobalt-tungsten and nickel-molybdenum. Typically such hydrotreating catalysts are presulfided. Preferred hydrotreating catalysts of the present invention comprise noble-metal such as platinum and/or palladium on an alumina support.

Hydroisomerization

As used herein, "hydroisomerization" refers to processes which isomerize normal paraffins to form isoparaffins. Typical hydroisomerization conditions are well known in the literature and can vary widely. Isomerization processes are typically carried out at a temperature between 200° F. and 700° F., preferably 300° F. to 650° F., with a LHSV between 0.1 and 10, preferably between 0.25 and 5. Hydrogen is employed such that the mole ratio of hydrogen to hydrocarbon is between 1:1 and 15:1. Catalysts useful for isomerization processes are generally bifunctional catalysts that include a dehydrogenation/hydrogenation component and an acidic component. The acidic component may include one or more of amorphous oxides such as alumina, silica or silica-alumina; a zeolitic material such as zeolite Y, ultrastable Y, SSZ-32, Beta zeolite, mordenite, ZSM-5 and the like, or a non-zeolitic molecular sieve such as SAPO-11, SAPO-31 and SAPO-41. The acidic component may further include a halogen component, such as fluorine. The hydrogenation component may be selected from the Group VIII noble metals such as platinum and/or palladium, from the Group VIII non-noble metals such as nickel and tungsten, and from the Group VI metals such as cobalt and molybdenum. If present, the platinum group metals will generally make up from about 0.1% to about 2% by weight of the catalyst. If present in the catalyst, the non-noble metal hydrogenation components generally make up from about 5% to about 40% by weight of the catalyst.

Hydrocracking

As used herein, "hydrocracking" refers to cracking hydrocarbon chains to form smaller hydrocarbons. This is generally accomplished by contacting hydrocarbon chains with hydrogen under increased temperature and/or pressure in the presence of a suitable hydrocracking catalyst. Hydrocracking catalysts with high selectivity for middle distillate products or naphtha products are known, and such catalysts are preferred. For hydrocracking, the reaction zone is maintained at hydrocracking conditions sufficient to effect a boiling range conversion of the VGO feed to the hydrocracking reaction zone, so that the liquid hydrocrackate recovered from the hydrocracking reaction zone has a normal boiling point range below the boiling point range of the feed. Typical hydrocracking conditions include: reaction temperature, 400° F.–950° F. (204° C.–510° C.), preferably 650° F.–850° F. (343° C.–454° C.); reaction pressure 500 to 5000 psig (3.5–34.5 MPa), preferably 1500–3500 psig (1 0.4–24.2 MPa); LHSV, 0.1 to 15 $hr^{-1}$ (v/v), preferably 0.25–2.5 $hr^{-1}$; and hydrogen consumption 500 to 2500 scf per barrel of liquid hydrocarbon feed (89.1–445 $m^3$ $H_2/m^3$ feed). The hydrocracking catalyst generally comprises a cracking component, a hydrogenation component and a binder. Such catalysts are well known in the art. The cracking component may include an amorphous silica/alumina phase and/or a zeolite, such as a Y-type or USY zeolite. The binder is generally silica or alumina. The hydrogenation component will be a Group VI, Group VII, or Group VIII metal or oxides or sulfides thereof, preferably one or more of molybdenum, tungsten, cobalt, or nickel, or the sulfides or oxides thereof. If present in the catalyst, these hydrogenation components generally make up from about 5% to about 40% by weight of the catalyst. Alternatively, platinum group metals, especially platinum and/or palladium, may be present as the hydrogenation component, either alone or in combination with the base metal hydrogenation components molybdenum, tungsten, cobalt, or nickel. If present, the platinum group metals will generally make up from about 0.1% to about 2% by weight of the catalyst.

The catalyst particles may have any shape known to be useful for catalytic materials, including spheres, fluted cylinders, prills, granules and the like. For non-spherical shapes, the effective diameter can be taken as the diameter of a representative cross section of the catalyst particles. The effective diameter of the zeolite catalyst particles is in the range of from about 1/32 inch to about 1/4 inch, preferably from about 1/20 inch to about 1/8 inch. The catalyst particles will further have a surface area in the range of from about 50 to about 500 $m^2/g$.

The hydroprocessing conditions can be varied depending on the fractions derived from the hydrocarbon synthesis step. For example, if the fractions include predominantly $C_{20}$+ hydrocarbons, the hydroprocessing conditions can be adjusted to hydrocrack the fraction and provide predominantly $C_{5-20}$ hydrocarbons. If the fractions include predominantly $C_{5-20}$ hydrocarbons, the hydroprocessing conditions can be adjusted to minimize hydrocracking. Those of skill in the art know how to modify reaction conditions to adjust amounts of hydrotreatment, hydroisomerization, and hydrocracking.

Heteroatom Removal

The natural gas condensate and, in those embodiments where sulfided catalysts are used, products derived from the natural gas condensate may include sulfur-containing compounds. Since the syngas is essentially sulfur-free, no appreciable amount of sulfur is likely to come from the hydrocarbon synthesis products, although oxygenates are often formed. The amount of sulfur in the blended stream to be co-hydroprocessed may meet the 200 ppm specification without additional treatment, particularly since the hydrocarbon synthesis products include such low levels of sulfur. In that case, it may not be necessary or desirable to remove the sulfur compounds. However, the natural gas condensate or the products of the co-hydroprocessing can be upgraded in separate vessels to remove heteroatom impurities and other undesirable materials.

Methods for removing heteroatom impurities are well known to those of skill in the art, and include, for example, extractive Merox, hydrotreating, adsorption, etc. Hydrotreating is the preferred means for removing these and other impurities.

While the invention has been described in terms of various preferred embodiments, the skilled artisan will appreciate that various modifications, substitutions, omissions and changes can be made without departing from the spirit thereof. Accordingly, it is intended that the scope of the present invention be limited solely by the scope of the following claims, including equivalents thereof.

What is claimed is:

1. A process for producing a hydrocarbon stream including $C_{5-20}$ normal and iso-paraffins, comprising:

(a) treating a methane-rich stream, which is isolated from a natural gas source, to remove sulfur-containing impurities contained therein;

(b) isolating a $C_{5+}$ natural gas condensate from the natural gas source;

(c) converting at least a portion of the methane-rich stream into syngas, and using the syngas in a hydrocarbon synthesis reaction;

(d) isolating a product stream including $C_{5-20}$ hydrocarbons from the hydrocarbon synthesis;

(e) blending at least a portion of the product stream including $C_{5-20}$ hydrocarbons from the hydrocarbon synthesis with at least a portion of the $C_{5+}$ natural gas condensate, to prepare a blended stream containing less than about 200 ppm sulfur;

(f) hydroprocessing the blended stream using a noble metal-containing catalyst; and (g) recovering at least one middle distillate product.

2. The process of claim 1, wherein the hydrocarbon synthesis step includes a Fischer-Tropsch synthesis process.

3. The process of claim 1, wherein the hydroprocessing conditions involve hydrotreatment and/or hydroisomerization.

4. The process of claim 1, wherein the hydroprocessing conditions involve using an acidic catalyst.

5. The method of claim 1, further comprising treating the hydroprocessed product to lower the concentration of heteroatoms after the hydroprocessing step.

6. The method of claim 1, further comprising isolating a $C_{20}$+ product stream from the hydrocarbon synthesis.

7. The method of claim 6, further comprising co-hydroprocessing the $C_{20}$+ product stream with the $C_{5-20}$ product stream.

8. The method of claim 7, wherein the hydroprocessing includes hydrocracking.

9. A process for producing a hydrocarbon stream including $C_{5-20}$ normal and iso-paraffins, comprising:

(a) treating a methane-rich stream, which is isolated from a natural gas source, to remove sulfur-containing impurities contained therein;

(b) isolating a natural gas condensate from the natural gas source, wherein the natural gas condensate may or may not include a significant amount of sulfur-containing impurities;

(c) converting at least a portion of the methane-rich stream into syngas, and using the syngas in a hydrocarbon synthesis reaction;

(d) isolating a product stream including $C_{20}$+ hydrocarbons from the hydrocarbon synthesis;

(e) blending at least a portion of the product stream including $C_{20}$+ hydrocarbons from the hydrocarbon synthesis with at least a portion of the natural gas condensate, to prepare a stream containing less than about 200 ppm of sulfur;

(f) hydroprocessing the blended stream using a noble metal-containing catalyst; and (g) recovering at least one middle distillate product.

10. The process of claim 9, wherein the hydrocarbon synthesis step is a Fischer-Tropsch synthesis.

11. The process of claim 9, wherein the hydroprocessing includes hydrocracking.

12. The process of claim 9, wherein the hydroprocessing includes hydrotreatment and/or hydroisomerization conditions.

13. The process of claim 9, wherein the hydroprocessing conditions involve using an acidic catalyst.

14. The method of claim 9, further comprising treating the hydroprocessed product to lower the concentration of heteroatoms after the hydroprocessing step.

15. The method of claim 9, further comprising isolating a $C_{5-20}$ product stream from the hydrocarbon synthesis.

16. The method of claim 15, further comprising co-hydroprocessing the $C_{5-20}$ product stream with the $C_{20}$+ product stream.

* * * * *